US008813278B2

(12) United States Patent
Cui et al.

(10) Patent No.: US 8,813,278 B2
(45) Date of Patent: Aug. 26, 2014

(54) HANDRAIL STRUCTURE ADAPTED TO CRIB

(75) Inventors: Zong-Wang Cui, Central (HK); Jonathan M. Pacella, Central (HK)

(73) Assignee: Wonderland Nurserygoods Company Limited, Central (HK)

( * ) Notice: Subject to any disclaimer, the term of this patent is extended or adjusted under 35 U.S.C. 154(b) by 1093 days.

(21) Appl. No.: 12/825,337

(22) Filed: Jun. 29, 2010

(65) Prior Publication Data

US 2011/0010848 A1 Jan. 20, 2011

(30) Foreign Application Priority Data

Jul. 16, 2009 (CH) ..... 2009 1 0150183

(51) Int. Cl.
*A47D 7/02* (2006.01)

(52) U.S. Cl.
USPC ..... 5/100; 5/430; 5/93.1; 5/99.1

(58) Field of Classification Search
USPC ..... 5/93.1, 99.1, 102
See application file for complete search history.

(56) References Cited

U.S. PATENT DOCUMENTS 6,721,971 B1 4/2004 Cheng
7,694,361 B1 4/2010 Chen
2007/0277308 A1 12/2007 Chen

FOREIGN PATENT DOCUMENTS

CN 2638562 Y 9/2004

*Primary Examiner* — Brittany Wilson
(74) *Attorney, Agent, or Firm* — Winston Hsu; Scott Margo

(57) ABSTRACT

A handrail structure adapted to a crib comprises a handrail member, a locking mechanism and a first pivoting member. A first pivoting portion of the handrail member is pivotally connected to the locking mechanism by the first pivoting member. A second pivoting portion of the handrail member is pivotally connected to a support member by a second pivoting member. The locking mechanism is capable of selectively locking or releasing the first pivoting portion. The second pivoting portion has an opening formed thereon and the second pivoting member is movably disposed in the opening. The second pivoting member abuts against a first edge of the opening when the locking mechanism locks the first pivoting portion. The handrail member is capable of being rotated with respect to at least one of the locking mechanism and the support member when the second pivoting member abuts against a second edge of the opening.

18 Claims, 11 Drawing Sheets

HANDRAIL STRUCTURE ADAPTED TO CRIB

BACKGROUND OF THE INVENTION

1. Field of the Invention

The invention relates to a handrail structure and, more particularly, to a handrail structure capable of preventing a handrail member thereof from incompletely locking. Specifically, the invention relates to a handrail structure adapted to a crib.

2. Description of the Prior Art

For a parent or other care giver, a crib is a practical tool to take care infants or children. In general, the crib provides rest or entertainment space for infants or children. A conventional crib always comprises four pillars and four handrails, and each handrail is connected between two pillars so as to form a closed space. To reduce space occupied by the crib for shipment and storage, most of the cribs are foldable so far and the size of the crib can be reduced after being folded. For folding purpose, the handrail usually consists of one locking mechanism and two handrail tubes.

As shown in FIG. 1, a conventional handrail tube 10 has a circular hole 100 formed thereon, a pillar 12 has a socket 14 attached thereon, and a rivet 16 passes through the circular hole 100 to pivotally connect the handrail tube 10 and the socket 14 on the pillar 12. Furthermore, a convention crib usually has a cloth (not shown) covering the handrail tube 10. Therefore, if the handrail tube 10 does not be completely locked by the locking mechanism (not shown) while using the crib, the handrail tube 10 will not collapse automatically due to the friction between the rivet and the circular hole 100 and the holding effect of the stretched covering cloth. At this time, since the handrail tube 10 is covered by the cloth, the user may not easily observe that the handrail tube 10 does not be completely locked by the locking mechanism. Consequently, the user may misconceive that the crib has been situated at a stable state. Under the aforesaid incomplete locking condition, if the infant, child or other user presses down the handrail incautiously, he or she may be clipped or the crib may collapse, so that unpredictable accident may occur.

SUMMARY OF THE INVENTION

An objective of the invention is to provide a handrail structure, which is adapted to a crib, capable of preventing a handrail member thereof from incompletely locking.

According to an embodiment of the invention, a handrail structure adapted to a crib comprises a handrail member, a locking mechanism and a first pivoting member. A first pivoting portion of the handrail member is pivotally connected to the locking mechanism by the first pivoting member. A second pivoting portion of the handrail member is pivotally connected to a support member by a second pivoting member. The locking mechanism is capable of selectively locking or releasing the first pivoting portion of the handrail member. The second pivoting portion of the handrail member has an opening formed thereon and the opening has a first edge and a second edge. The second pivoting member passes through the opening to connect the support member and the handrail member. The opening is movable relate to the second pivoting member when the locking mechanism releases the first pivoting portion of the handrail member.

The second pivoting member abuts against the first edge of the opening when the locking mechanism completely locks the first pivoting portion of the handrail member. The handrail member is capable of being rotated with respect to at least one of the locking mechanism and the support member when the second pivoting member abuts against the second edge of the opening.

In other words, when the locking mechanism does not lock the first pivoting portion of the handrail member, the second pivoting portion of the handrail member will move with respect to the support member, such that the second pivoting member will move from the first edge to the second edge of the opening. Afterward, when the second pivoting member abuts against the second edge of the opening, the first pivoting portion of the handrail member will rotate with respect to the locking mechanism and the second pivoting portion of the handrail member will rotate with respect to the support member.

In one embodiment, the opening has a longitudinal shape.

In another embodiment, the opening has an arc shape.

In another embodiment, the opening comprises a first longitudinal opening and a second longitudinal opening, the first longitudinal opening communicates with the second longitudinal opening, and a predetermined angle is between the first longitudinal opening and the second longitudinal opening.

A predetermined angle is between an axial direction of the second pivoting portion of the handrail member and an extended direction of the opening.

The support member comprises a socket, the socket has a groove, and the second pivoting portion of the handrail member is pivotally connected to the groove of the socket by the second pivoting member.

The handrail member has a protruding portion, the protruding portion is adjacent to the second pivoting portion, and a width of the protruding portion is larger than that of the groove.

A pad is attached on an inner end of the groove, and the second pivoting portion of the handrail member abuts against the pad when the locking mechanism locks the first pivoting portion of the handrail member.

The pad can be a spring or a resilient piece.

According to another embodiment of the invention, a handrail structure adapted to a crib comprises a handrail member, a locking mechanism and a first pivoting member. A first pivoting portion of the handrail member is pivotally connected to the locking mechanism by the first pivoting member. A second pivoting portion of the handrail member is pivotally connected to a support member by a second pivoting member. The locking mechanism is capable of selectively locking or releasing the first pivoting portion of the handrail member. The first pivoting portion of the handrail member has an opening formed thereon and the opening has a first edge and a second edge. The first pivoting member passes through the groove to connect the locking mechanism and the handrail member. The opening is movable relate to the first pivoting member when the locking mechanism releases the first pivoting portion of the handrail member.

The first pivoting member abuts against the first edge of the opening when the locking mechanism locks the first pivoting portion of the handrail member. The handrail member is capable of being rotated with respect to at least one of the locking mechanism and the support member when the first pivoting member abuts against the second edge of the opening.

In other words, when the locking mechanism does not completely lock the first pivoting portion of the handrail member, the first pivoting portion of the handrail member will move with respect to the support member, such that the first pivoting member will move from the first edge to the second edge of the opening. Afterward, when the first pivoting member abuts against the second edge of the opening, the first pivoting portion of the handrail member will rotate with respect to the locking mechanism and the second pivoting portion of the handrail member will rotate with respect to the support member.

In one embodiment, the opening has a longitudinal shape.

In another embodiment, the opening has an arc shape.

In another embodiment, the opening comprises a first longitudinal opening and a second longitudinal opening, the first longitudinal opening communicates with the second longitudinal opening, and a predetermined angle is between the first longitudinal opening and the second longitudinal opening.

A predetermined angle is between an axial direction of the first pivoting portion of the handrail member and an extended direction of the opening.

The support member comprises a socket, the socket has a groove, and the second pivoting portion of the handrail member is pivotally connected to the groove of the socket by the second pivoting member.

The handrail member has a protruding portion, the protruding portion is adjacent to the second pivoting portion, and a width of the protruding portion is larger than that of the groove.

A pad is attached on an inner end of the groove, and the second pivoting portion of the handrail member abuts against the pad when the locking mechanism completely locks the first pivoting portion of the handrail member.

The pad can be a spring or a resilient piece.

According to the aforesaid embodiments, the handrail structure of the invention has the following advantages and useful effects. The invention selectively forms an opening on the first or second pivoting portion of the handrail member. Once the handrail member does not be completely locked, one end of the handrail member close to the locking mechanism (i.e. the first pivoting portion) will move downwardly together with the locking mechanism, and the other end close to the socket (i.e. the second pivoting portion) will rotate correspondingly. Due to the opening, the handrail member can move continuously with respect to one of the socket and the locking mechanism and then rotate, so that the handrail member will collapse automatically once it does not be locked completely. Consequently, a user can easily observe that the handrail member does not be completely locked by the locking mechanism.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
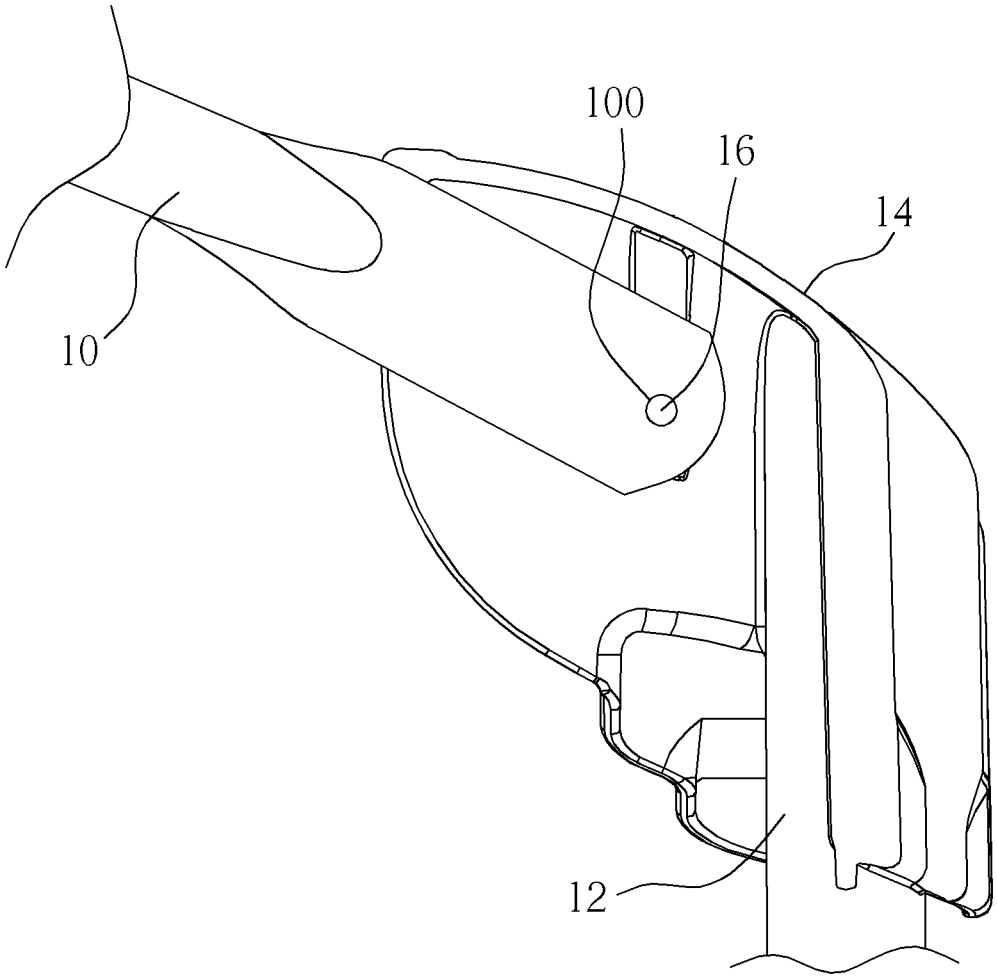
FIG. 1 PRIOR ART
FIG. 1 is a schematic diagram illustrating that a conventional handrail tube is connected to a socket on a pillar.
Figure 2:
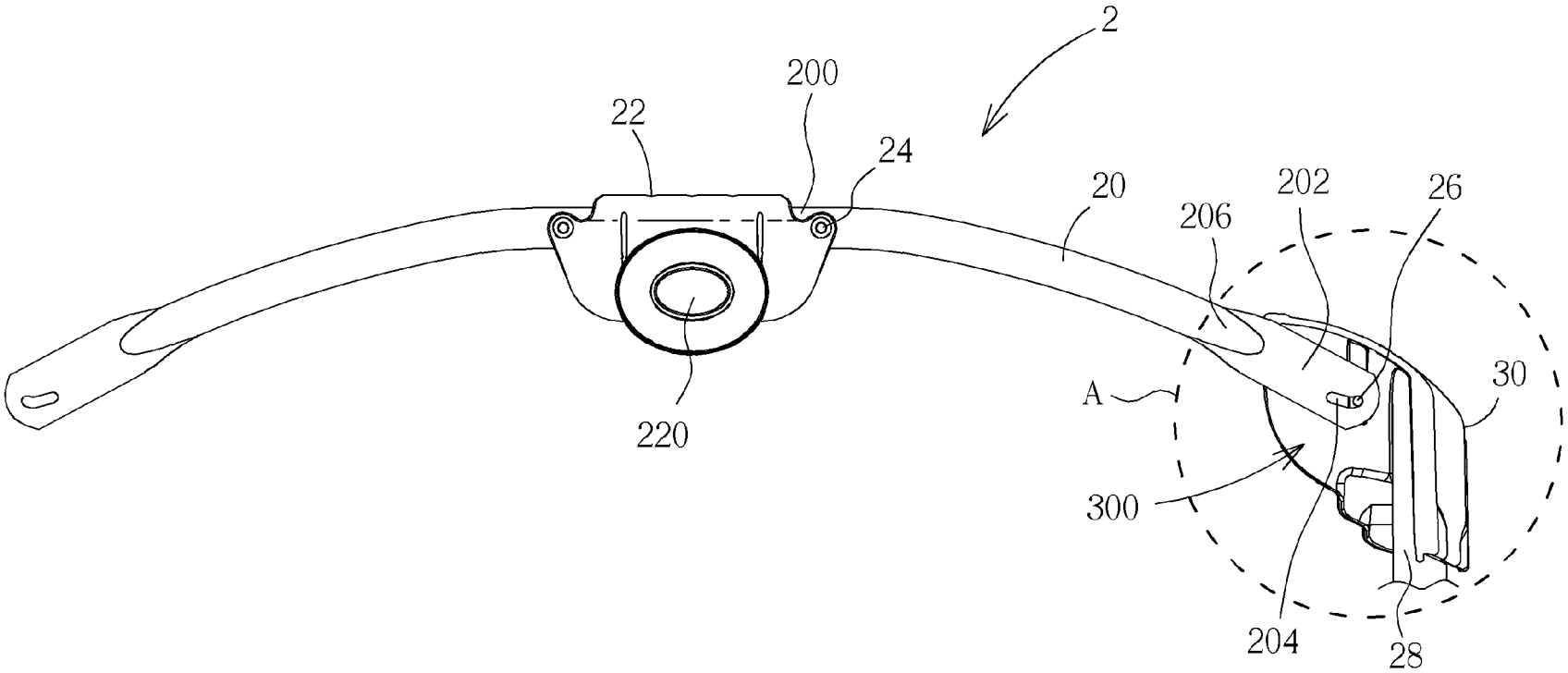
FIG. 2 is a schematic diagram illustrating that a handrail member of the invention is locked completely.

As shown in FIG. 2, the handrail structure 2 is symmetrical. For illustrative purpose, only one side of the handrail structure 2 is adopted along with corresponding drawings in the following description. The handrail structure 2 of the invention can be adapted, but not limited, to a crib, such that the crib is foldable and the size of the crib can be reduced after being folded. Furthermore, the handrail structure 2 of the invention also can be adapted to any devices or equipments equipped with handrail or the like. In general, a crib consists of closed railings, and the handrail structure 2 shown in FIG. 2 represents one side of the crib.

Figure 3:
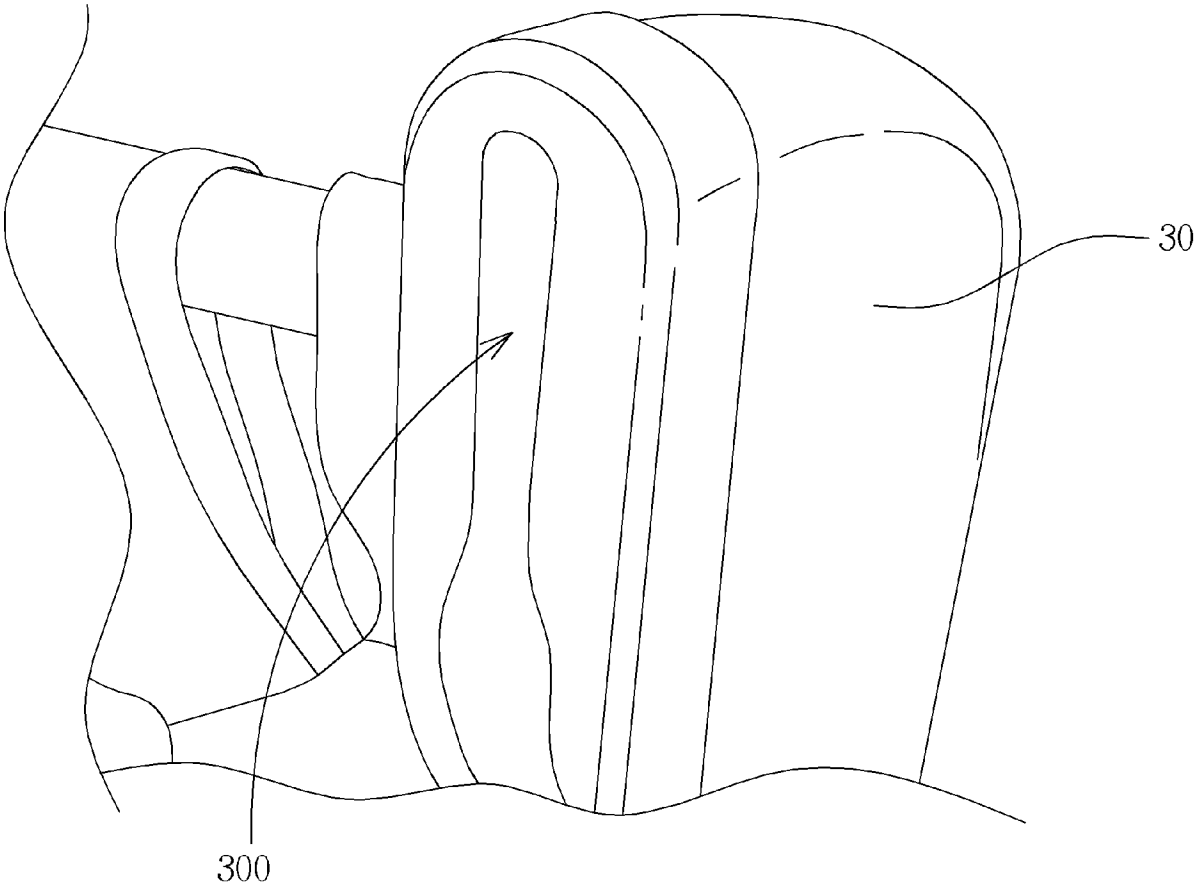
FIG. 3 is a schematic diagram illustrating the socket shown in FIG. 2.

According to an embodiment of the invention, the handrail structure 2 comprises a handrail member 20, a locking mechanism 22 and a first pivoting member 24. A first pivoting portion 200 of the handrail member 20 is pivotally connected to the locking mechanism 22 by the first pivoting member 24. A second pivoting portion 202 of the handrail member 20 is pivotally connected to a socket 30 on a support member 28 by a second pivoting member 26 holding by the socket 30. The locking mechanism 22 is capable of selectively locking or releasing the first pivoting portion 200 of the handrail member 20. In this embodiment, the first pivoting member 24 and the second pivoting member 26 can be, but not limited to, rivets. The socket 30 is attached on a top end of the support member 28. As shown in FIG. 3, the socket 30 has a groove 300. The second pivoting portion 202 of the handrail member 20 is placed into the groove 300 and pivotally connected to the socket 30 by the second pivoting member 26. There is a button 220 attached on the locking mechanism 22. Before pressing the button 220, the locking mechanism 22 can lock the first pivoting portion 200 of the handrail member 20 steadily, such that the handrail structure 2 can be kept at an opened state, as shown in FIG. 2. On the other hand, after pressing the button 220, the locking mechanism 22 will release the first pivoting portion 200 of the handrail member 20 to pivot.

The second pivoting portion 202 of the handrail member 20 has an opening 204 formed thereon. The second pivoting member 26 is disposed in the opening 204, such that the handrail member 20 can rotate with respect to the second pivoting member 26. As shown in FIG. 3, the opening 204 has a first edge E1 and a second edge E2. In this embodiment, the opening 204 comprises a first longitudinal opening 2040 and a second longitudinal opening 2042, the first longitudinal opening 2040 communicates with the second longitudinal opening 2042, and a predetermined angle $\alpha$ is between the first longitudinal opening 2040 and the second longitudinal opening 2042. The opening 204 provides a space wherein the second pivoting portion 202 can move relate to the second pivoting member 26 and the socket 30. Furthermore, a predetermined angle $\beta$ is between an axial direction of the second pivoting portion 202 of the handrail member 20 and an extended direction of the first longitudinal opening 2040. It should be noted that the predetermined angles $\alpha$ and $\beta$ may enable the handrail member 20 to collapse automatically while it does not be locked completely by the locking mechanism 22 and the two angles $\alpha$ and $\beta$ can be determined based on practical structure of a crib.

As shown in FIGS. 2 and 3, when the locking mechanism 22 completely locks the first pivoting portion 200 of the handrail member 20, a crib (not shown) can be supported in a steady state by the handrail structure 2. At this time, the second pivoting member 26 abuts against the first edge E1 of the opening 204. In this embodiment, the second pivoting portion 202 of the handrail member 20 has a flat shape, so the second pivoting portion 202 of the handrail member 20 can be inserted into the groove 300 of the socket 30. Then, the second pivoting member 26 is passed through a hole (not shown) formed on the socket 30 and the opening 204, so that the second pivoting portion 202 of the handrail member 20 is pivotally connected to the socket 30 through the groove 300. Furthermore, the handrail member 20 has a protruding portion 206 adjacent to the second pivoting portion 202 and a width of the protruding portion 206 is larger than that of the groove 300 of the socket 30. In other words, only the second pivoting portion 202 of the handrail member 20 can be inserted into the groove 300 of the socket 30 and the protruding portion 206 will abut against the sidewall of the groove 300. Accordingly, when the locking mechanism 22 completely locks the first pivoting portion 200 of the handrail member 20, the handrail member 20 will not move or swing with respect to the socket 30 despite the opening 204.

Figure 5:
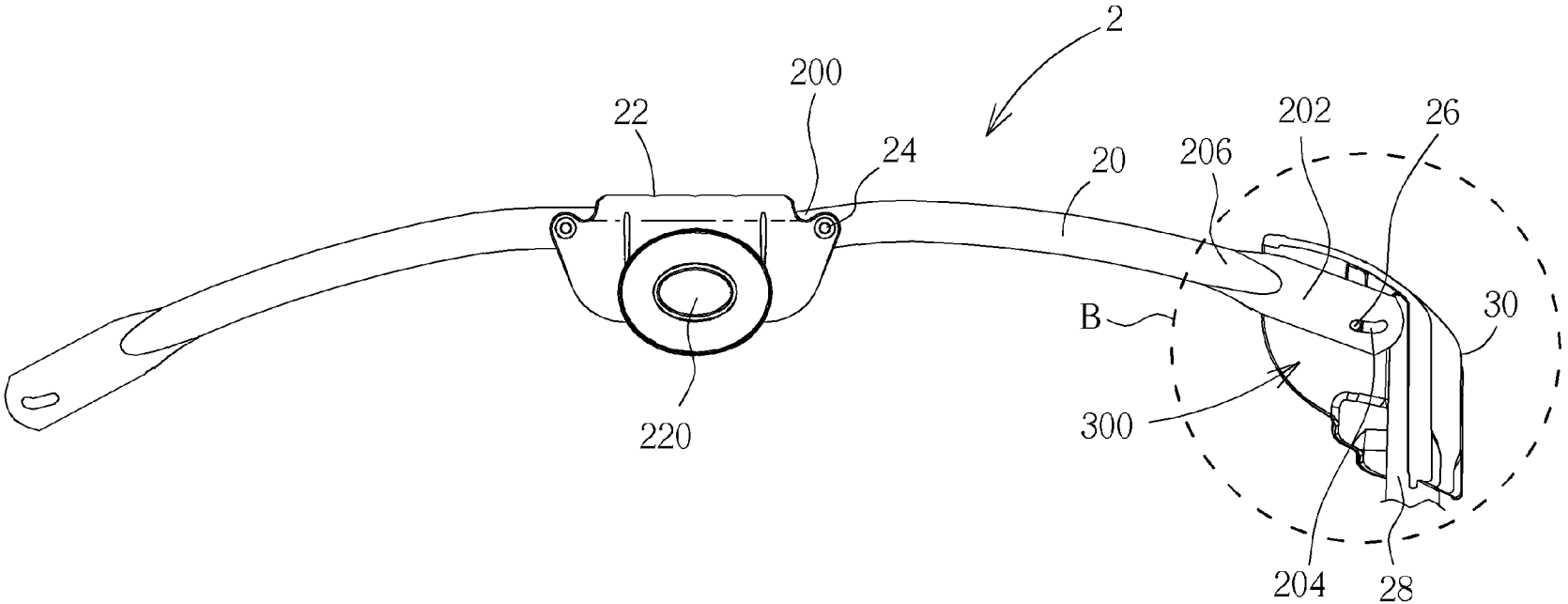
FIG. 5 is a schematic diagram illustrating that the handrail member of the invention does not be locked completely.
Figure 6:
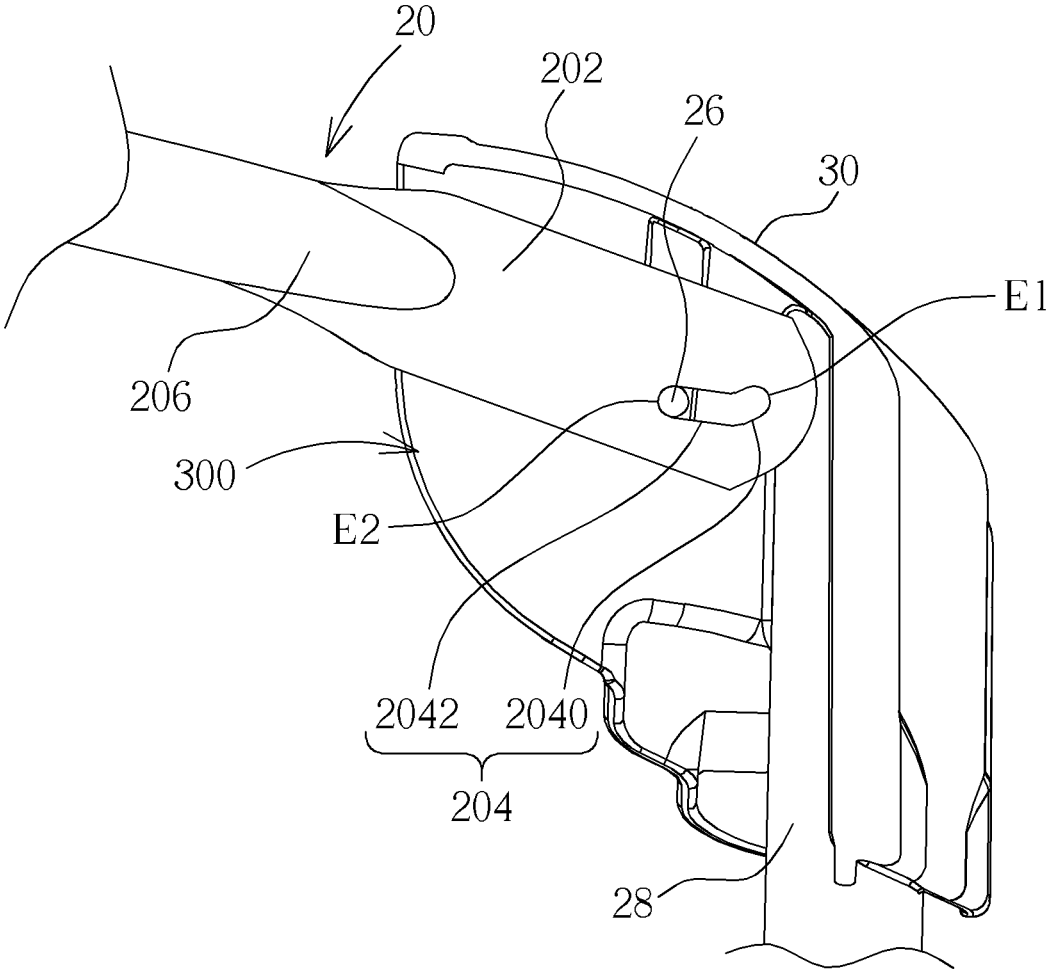
FIG. 6 is an enlarged view illustrating the area B shown in FIG. 5.

Once the locking mechanism 22 does not completely lock the first pivoting portion 200 of the handrail member 20, the second pivoting portion 202 of the handrail member 20 will move automatically and downwardly with respect to the support member 28 due to the weights of the handrail member 20 and the locking mechanism 22 and the height difference between the first pivoting portion 200 and the second pivoting portion 202. The second pivoting portion 202 will move along the direction of the first longitudinal opening 2040 and the second longitudinal opening 2042 by the cooperation of the second pivoting member 26 and the opening 204, so that the opening edge abuts against the second pivoting member 26 is changing from the first edge E1 to the second edge E2, as shown in FIGS. 5 and 6. At this time, the second pivoting member 26 abuts against the second edge E2 of the opening 204.

Figure 7:
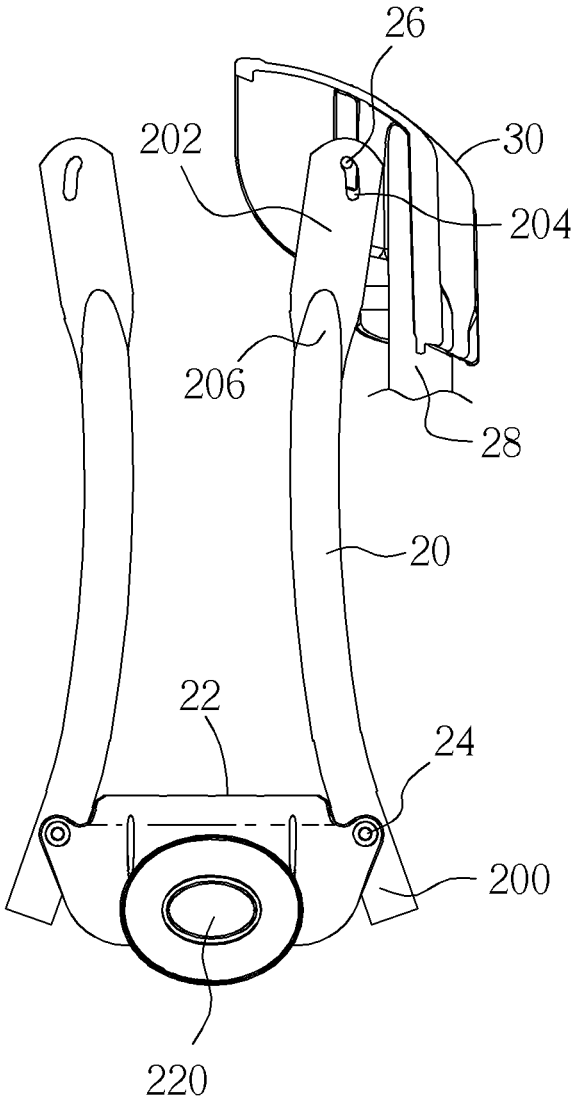
FIG. 7 is a schematic diagram illustrating that the handrail member of the invention collapses downwardly.

When the second pivoting member 26 abuts against the second edge E2 of the opening 204, due to the weights of the handrail member 20 and the locking mechanism 22, the first pivoting portion 200 of the handrail member 20 will pivot on the first pivoting member 24 and with respect to the locking mechanism. 22, and the second pivoting portion 202 of the handrail member 20 will pivot on the second pivoting member 26 and with respect to the socket 30 on the support member 28. At this time, the handrail member 20 will collapse automatically. If both handrail members 20, which are attached on opposite sides of the locking mechanism 22, do not be locked completely, the two handrail members 20 will collapse automatically, as shown in FIG. 7. Therefore, a user can easily observe that the handrail member 20 does not be completely locked, so as to prevent unpredictable accident.

It should be noted that if the support member 28 of a crib does not be restrained and can move freely, it usually tends to topple over inwardly. Therefore, once the locking mechanism 22 does not completely lock the first pivoting portion 200 of the handrail member 20, the support member 28 will topple over inwardly and then a force is generated to force the second pivoting member 26 to move along the opening 204, such that the handrail member 20 will collapse automatically. In other words, even though the handrail member 20 is covered by a cloth, it will still collapse automatically under incomplete locking condition.

Figure 4:
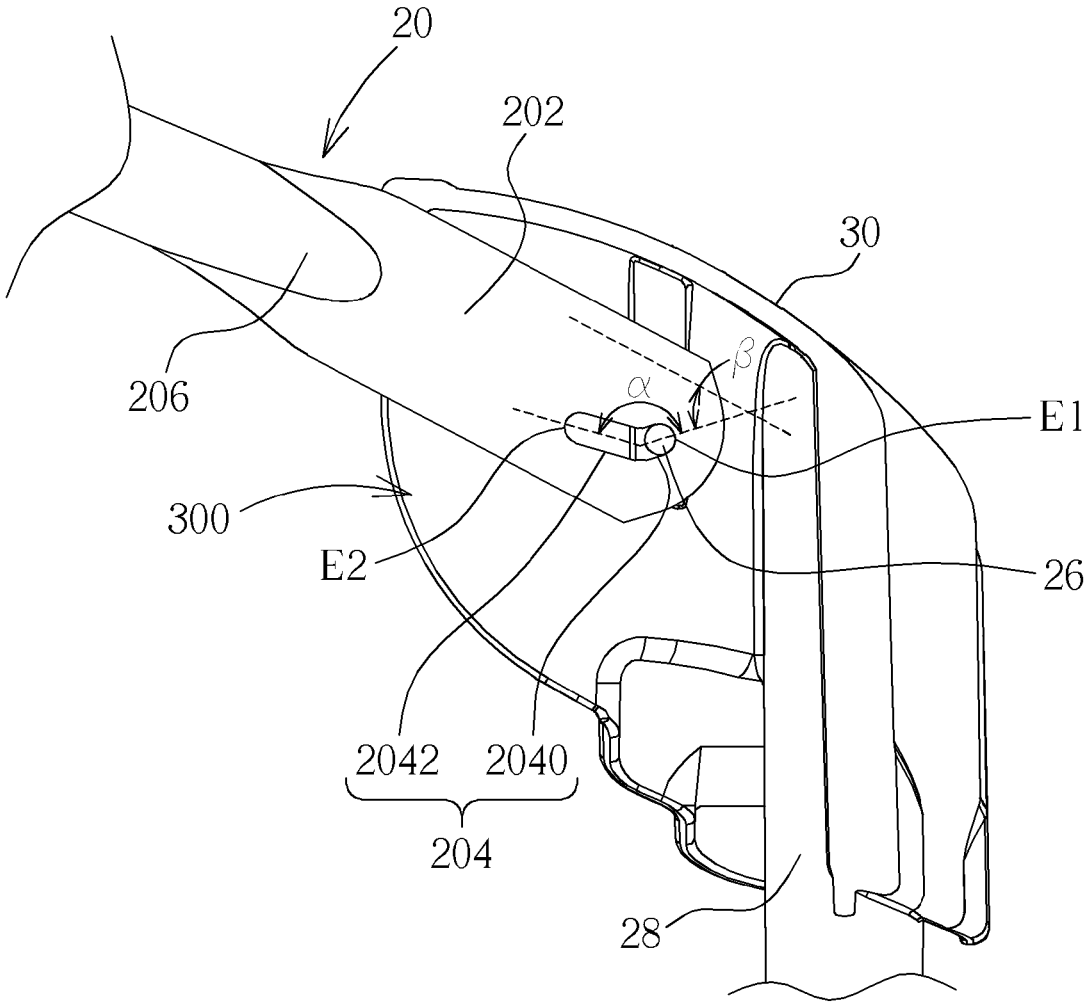
FIG. 4 is an enlarged view illustrating the area A shown in FIG. 2.
Figure 8:
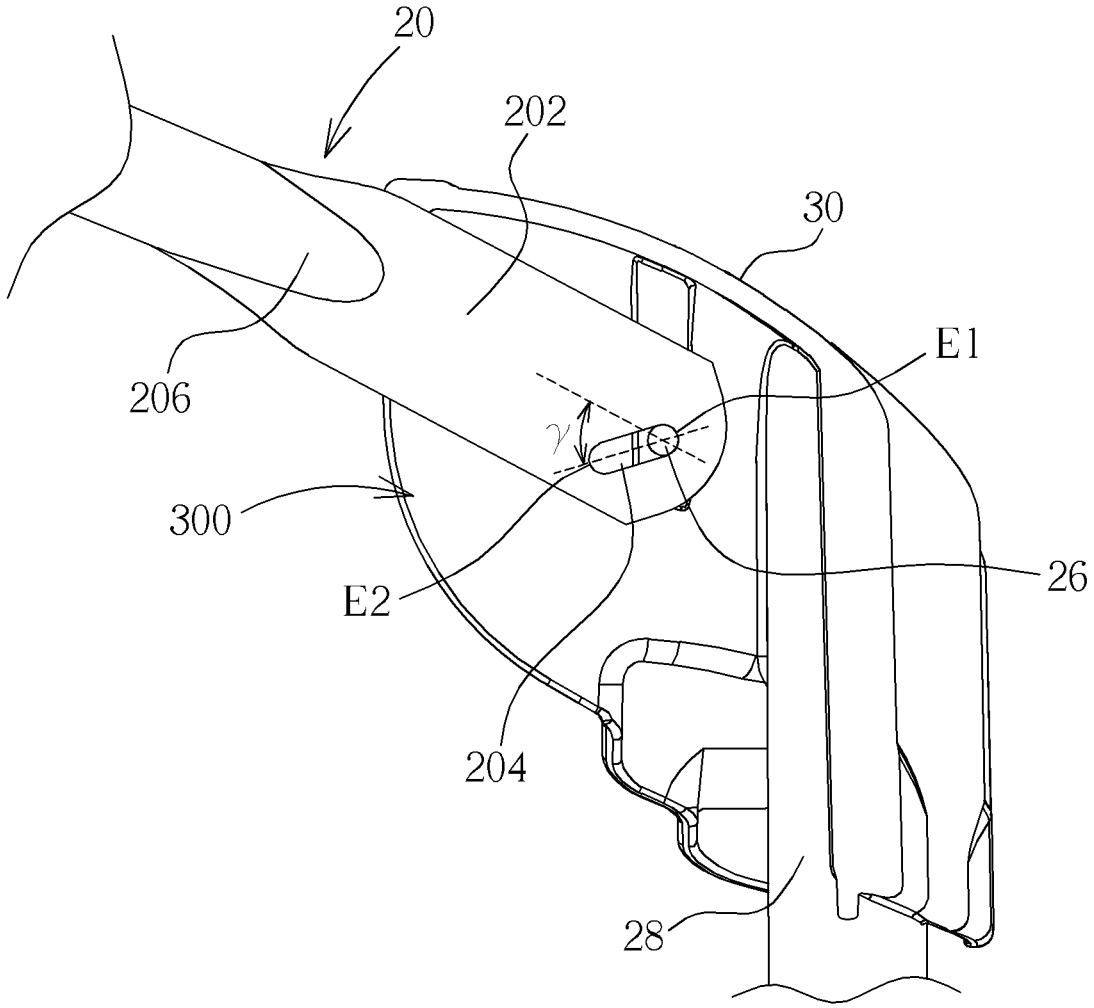
FIG. 8 is a schematic diagram illustrating a handrail member according to another embodiment of the invention.

As shown in FIG. 8, according to another embodiment of the invention, the opening 204 formed on the second pivoting portion 202 of the handrail member 20 can be replaced by one single longitudinal opening. A predetermined angle γ is between an axial direction of the second pivoting portion 202 of the handrail member 20 and an extended direction of the longitudinal opening 204. The predetermined angle γ may enable the handrail member 20 to collapse automatically while it does not be locked completely and the angle γ can be determined based on practical structure of a crib, it can be any degree in the range from 45 to 75 degree. Preferably, the predetermined angle γ can be, but not limited to, 60 degree. It should be noted that the elements with the same numerals in FIGS. 8 and 4 have the same structure and principle and the related description does not be described here again.

Figure 9:
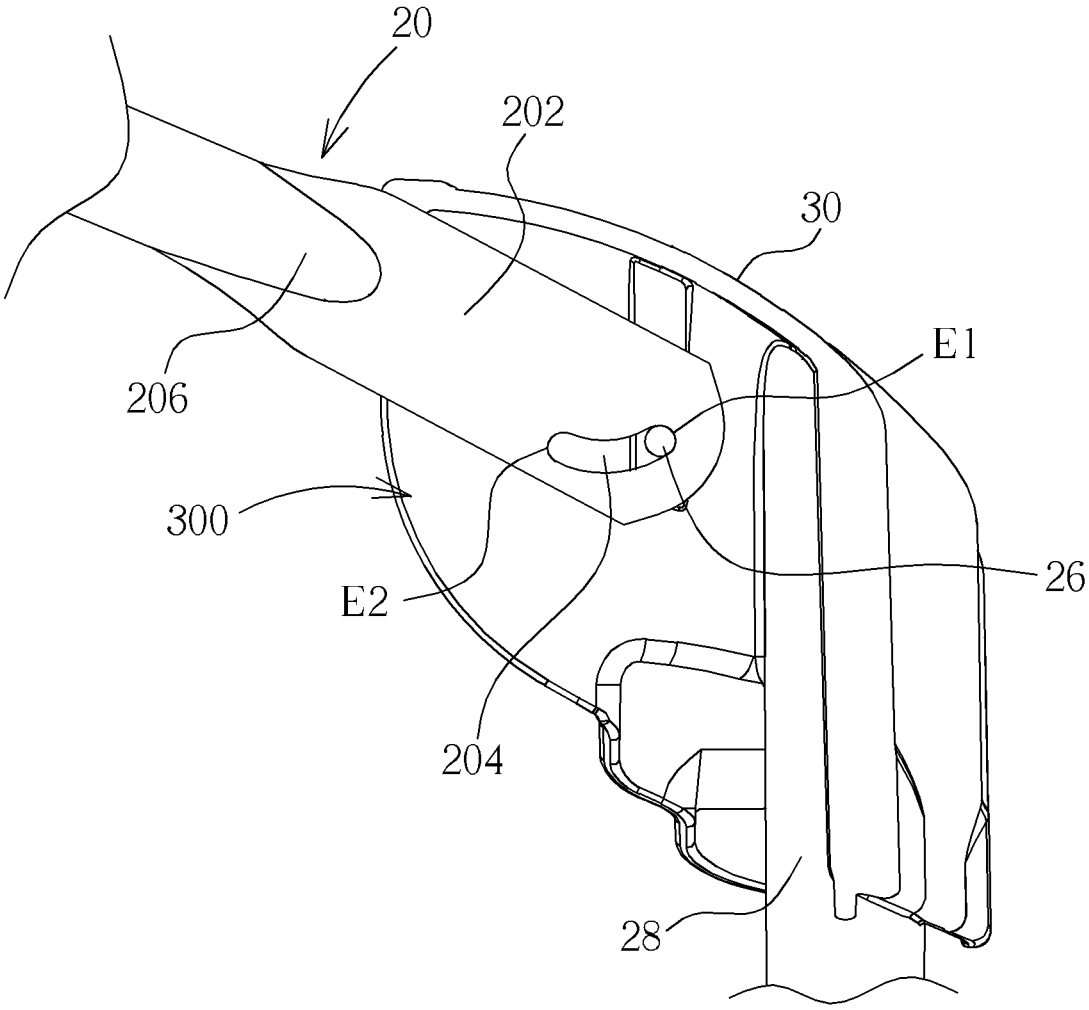
FIG. 9 is a schematic diagram illustrating a handrail member according to another embodiment of the invention.

As shown in FIG. 9, according to another embodiment of the invention, the opening 204 formed on the second pivoting portion 202 of the handrail member 20 can be replaced by an arc opening. It should be noted that the elements with the same numerals in FIGS. 9 and 4 have the same structure and principle and the related description does not be described here again.

Figure 10:
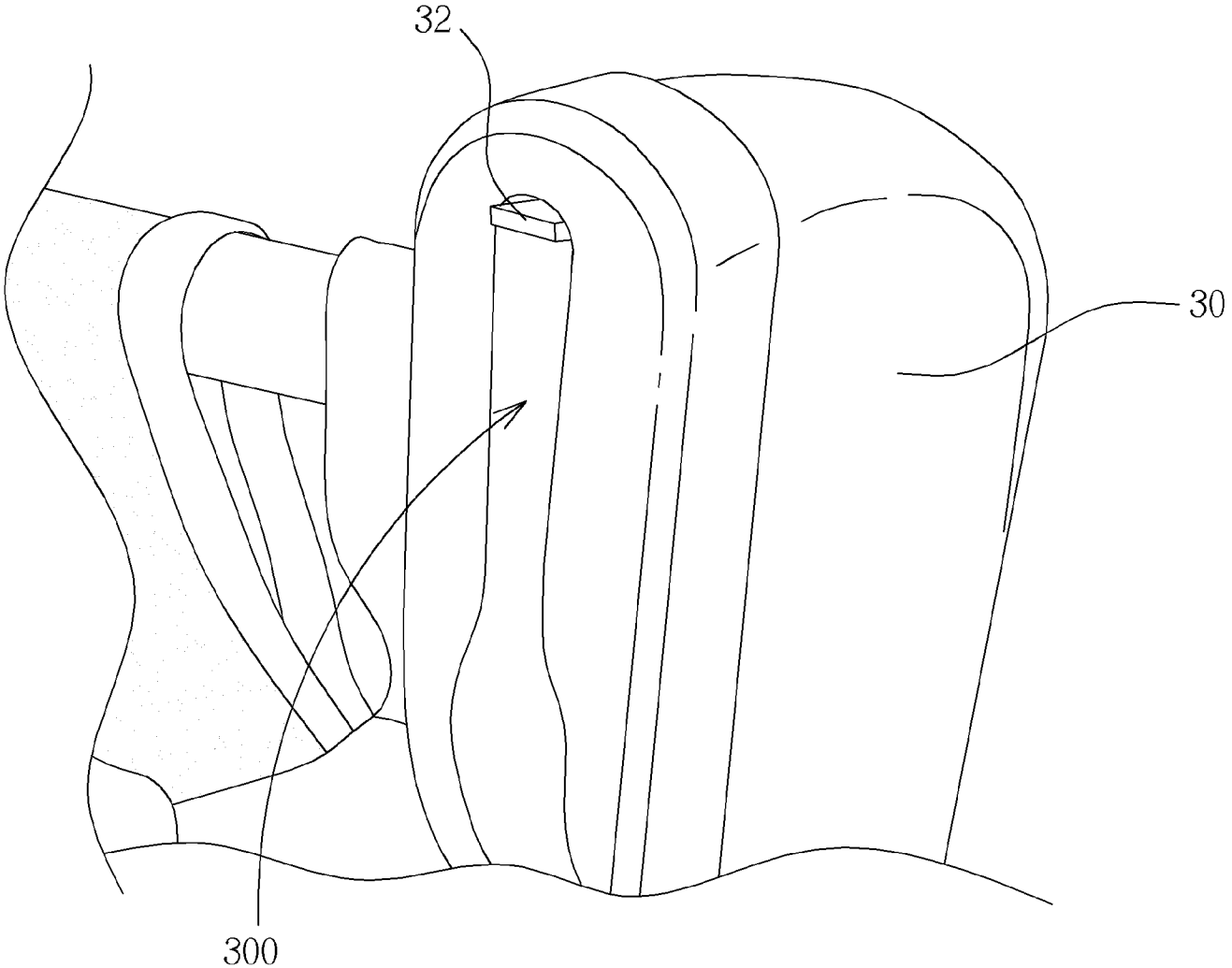
FIG. 10 is a schematic diagram illustrating that a pad is attached on the groove of the socket according to another embodiment of the invention.

As shown in FIG. 10, according to another embodiment of the invention, a pad 32 can be attached on an inner end of the groove 300 of the socket 30. The second pivoting portion 202 of the handrail member 20 abuts against the pad 32 when the locking mechanism 22 completely locks the first pivoting portion 200 of the handrail member 20. Once the locking mechanism 22 does not completely lock the first pivoting portion 200 of the handrail member 20, the handrail member 20 is located at a lower position due to a thickness of the pad 32 and then falls freely by gravity. Preferably, the pad 32 can be, but not limited to, a spring or a resilient piece.

Figure 11:
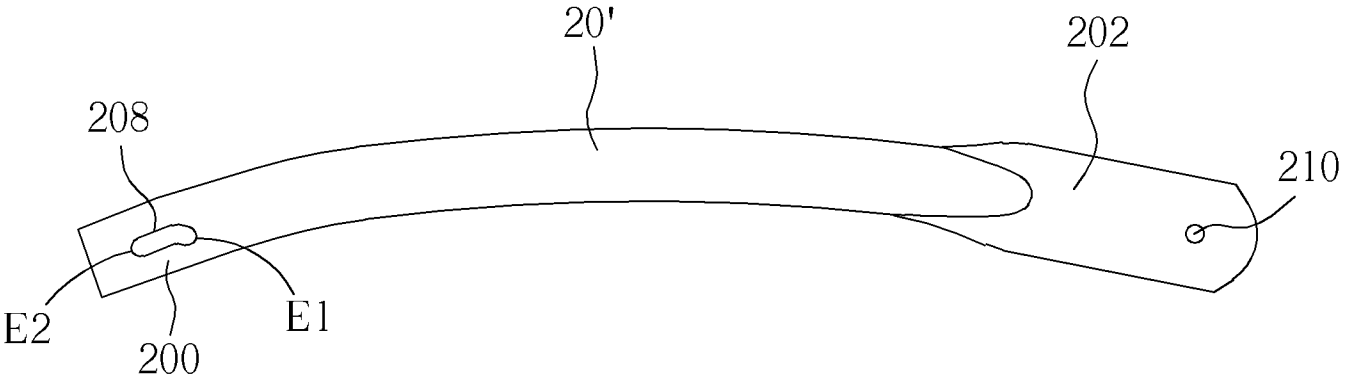
FIG. 11 is a schematic diagram illustrating a handrail member according to another embodiment of the invention.

As shown in FIG. 11, according to another embodiment of the invention, an opening 208 is formed on the first pivoting portion 200 of the handrail member 20' and a circular hole 210 is formed on the second pivoting portion 202. Also, referring to FIG. 2, if the handrail member 20 shown in FIG. 2 is replaced by the handrail member 20' shown in FIG. 11, the opening 208 makes the handrail member 20' is capable to move with respect to the first pivoting member 24. When the locking mechanism 22 completely locks the first pivoting portion 200 of the handrail member 20', the first pivoting member 24 abuts against the first edge E1 of the opening 208. Once the locking mechanism 22 does not completely lock the first pivoting portion 200 of the handrail member 20', the first pivoting portion 200 of the handrail member 20' will move with respect to the support member 28, such that the first pivoting member 24 will abuts against the second edge E2 of the opening 208 rather than the first edge E1. When the first pivoting member 24 abuts against the second edge E2 of the opening 208, the first pivoting portion 200 of the handrail member 20' will pivot on the first pivoting member 24 and with respect to the locking mechanism 22, and the second pivoting portion 202 of the handrail member 20' will pivot on the second pivoting member 26 and with respect to the support member 28. At this time, the handrail member 20' will collapse automatically. Therefore, a user can easily observe that the handrail member 20' does not be completely locked, so as to prevent unpredictable accident. In other embodiments of the invention, the opening 208 shown in FIG. 11 also can be replaced by the single longitudinal opening shown in FIG. 8 or the arc opening shown in FIG. 9.

According to the aforesaid embodiments, the handrail structure of the invention has the following advantages and useful effects. The invention selectively forms an opening on the first or second pivoting portion of the handrail member.

Once the handrail member does not be completely locked, one end of the handrail member close to the locking mechanism (i.e. the first pivoting portion) will move downwardly together with the locking mechanism, and the other end close to the socket (i.e. the second pivoting portion) will rotate correspondingly. Due to the opening, the handrail member can move continuously with respect to one of the socket and the locking mechanism and then rotate, so that the handrail member will collapse automatically once it does not be locked completely. Consequently, a user can easily observe that the handrail member does not be completely locked by the locking mechanism.

Those skilled in the art will readily observe that numerous modifications and alterations of the device and method may be made while retaining the teachings of the invention.

What is claimed is:

1. A handrail structure adapted to a crib, the handrail structure comprising:

a handrail member;

a locking mechanism and a first pivoting member;

a first pivoting portion of the handrail member being pivotally connected to the locking mechanism by the first pivoting member;

a second pivoting portion of the handrail member being pivotally connected to a support member by a second pivoting member; and the locking mechanism being capable of selectively locking or releasing the first pivoting portion of the handrail member, the second pivoting portion of the handrail member having an opening formed thereon, the second pivoting member passing through the opening to connect the support member and the handrail member;

wherein the opening is movable relate to the second pivoting member when the locking mechanism releases the first pivoting portion of the handrail member; and wherein a predetermined angle is between an axial direction of the second pivoting portion of the handrail member and an extended direction of the opening.

2. The handrail structure of claim 1, wherein the opening has a first edge and a second edge, the second pivoting member abuts against the first edge of the opening when the locking mechanism locks the first pivoting portion of the handrail member, and the handrail member is capable of being rotated with respect to at least one of the locking mechanism and the support member when the second pivoting member abuts against the second edge of the opening.

3. The handrail structure of claim 1, wherein the opening has a longitudinal shape.

4. The handrail structure of claim 1, wherein the opening has an arc shape.

5. The handrail structure of claim 1, wherein the opening comprises a first longitudinal opening and a second longitudinal opening, the first longitudinal opening communicates with the second longitudinal opening, and a predetermined angle is between the first longitudinal opening and the second longitudinal opening.

6. The handrail structure of claim 1, wherein the support member comprises a socket, the socket has a groove, and the second pivoting portion of the handrail member is pivotally connected to the groove of the socket by the second pivoting member.

7. The handrail structure of claim 6, wherein the handrail member has a protruding portion, the protruding portion is adjacent to the second pivoting portion, and a width of the protruding portion is larger than that of the groove.

8. The handrail structure of claim 6, wherein a pad is attached on an inner end of the groove, the second pivoting portion of the handrail member abuts against the pad when the locking mechanism completely locks the first pivoting portion of the handrail member.

9. The handrail structure of claim 8, wherein the pad is a spring or a resilient piece.

10. A handrail structure adapted to a crib, the handrail structure comprising:

a handrail member;

a locking mechanism and a first pivoting member;

a first pivoting portion of the handrail member being pivotally connected to the locking mechanism by the first pivoting member;

a second pivoting portion of the handrail member being pivotally connected to a support member by a second pivoting member; and the locking mechanism being capable of selectively locking or releasing the first pivoting portion of the handrail member, the first pivoting portion of the handrail member having an opening formed thereon, the first pivoting member passing through the opening to connect the locking mechanism and the handrail member;

wherein the opening is movable relate to the first pivoting member when the locking mechanism releases the first pivoting portion of the handrail member; and wherein a predetermined angle is between an axial direction of the first pivoting portion of the handrail member and an extended direction of the opening.

11. The handrail structure of claim 10, wherein the opening has a first edge and a second edge, the first pivoting member abuts against the first edge of the opening when the locking mechanism locks the first pivoting portion of the handrail member, and the handrail member is capable of being rotated with respect to at least one of the locking mechanism and the support member when the first pivoting member abuts against the second edge of the opening.

12. The handrail structure of claim 10, wherein the opening has a longitudinal shape.

13. The handrail structure of claim 10, wherein the opening has an arc shape.

14. The handrail structure of claim. 10, wherein the opening comprises a first longitudinal opening and a second longitudinal opening, the first longitudinal opening communicates with the second longitudinal opening, and a predetermined angle is between the first longitudinal opening and the second longitudinal opening.

15. The handrail structure of claim 10, wherein the support member comprises a socket, the socket has a groove, and the second pivoting portion of the handrail member is pivotally connected to the groove of the socket by the second pivoting member.

16. The handrail structure of claim 15, wherein the handrail member has a protruding portion, the protruding portion is adjacent to the second pivoting portion, and a width of the protruding portion is larger than that of the groove.

17. The handrail structure of claim 15, wherein a pad is attached on an inner end of the groove, the second pivoting portion of the handrail member abuts against the pad when the locking mechanism completely locks the first pivoting portion of the handrail member.

18. The handrail structure of claim 17, wherein the pad is a spring or a resilient piece.

* * * * *